US010320073B2

(12) United States Patent
Sleight et al.

(10) Patent No.: US 10,320,073 B2
(45) Date of Patent: Jun. 11, 2019

(54) MOBILE TERMINAL ANTENNA ALIGNMENT USING ARBITRARY ORIENTATION ATTITUDE

(71) Applicant: ViaSat, Inc., Carlsbad, CA (US)

(72) Inventors: Brian T. Sleight, Carlsbad, CA (US); David H. Schmitz, Encinitas, CA (US); Clifford K. Burdick, Vista, CA (US); Arthur S. Loh, San Diego, CA (US)

(73) Assignee: Viasat, Inc., Carlsbad, CA (US)

( * ) Notice: Subject to any disclaimer, the term of this patent is extended or adjusted under 35 U.S.C. 154(b) by 314 days.

(21) Appl. No.: 14/595,025

(22) Filed: Jan. 12, 2015

(65) Prior Publication Data

US 2015/0200449 A1 Jul. 16, 2015

Related U.S. Application Data

(60) Provisional application No. 61/927,322, filed on Jan. 14, 2014.

(51) Int. Cl.
*H01Q 3/08* (2006.01)
*H01Q 1/28* (2006.01)

(52) U.S. Cl.
CPC ..... *H01Q 3/08* (2013.01); *H01Q 1/28* (2013.01)

(58) Field of Classification Search
CPC .... H01Q 1/1257; H01Q 1/125; H01Q 1/3275; H01Q 1/52; H01Q 1/246; H01Q 1/325; H01Q 3/08; H01Q 3/04; H01Q 3/26; H01Q 3/46; H01Q 3/14; H01Q 3/44; H01Q 19/062; H01Q 25/008; H04W 16/28; H04B 7/10; G01S 1/02
See application file for complete search history.

(56) References Cited

U.S. PATENT DOCUMENTS 6,657,588 B2 12/2003 Strickland et al.
7,009,558 B1 * 3/2006 Fall ..... G01S 19/47 342/359

(Continued)

OTHER PUBLICATIONS

Markley et al., "How to Estimate Attitude from Vector Observations", AAS 99-427, Proceedings of the AAS/AIAA Astrodynamics Specialist Conference, vol. 103, No. 3, 1999, 18 pgs.

*Primary Examiner* — Vladimir Magloire
*Assistant Examiner* — Daniel P Malley, Sr.
(74) *Attorney, Agent, or Firm* — Holland & Hart LLP

(57) ABSTRACT

Systems and methods for aligning a satellite antenna mounted on a mobile platform to the platform are disclosed. At each of several arbitrary orientations, a first directional vector is determined from the antenna to a satellite. For each orientation, an alias transformation is performed to transform the first vector having coordinates defined with respect to a first reference frame to a second vector having coordinates defined with respect to a second reference frame. A third vector is determined based on the orientation of the antenna after peaking the antenna. A rotation matrix is derived from the collection of second and third vectors. An estimate of the rotational offset of the satellite antenna with respect to the platform is determined based on the rotation matrix. The rotational offset is applied to the attitude of the platform to accurately point the antenna to the satellite.

36 Claims, 9 Drawing Sheets

(56) References Cited

U.S. PATENT DOCUMENTS

| | | | | |
|---|---|---|---|---|
| 7,095,376 | B1 * | 8/2006 | Timothy | H01Q 3/08 343/705 |
| 7,218,273 | B1 * | 5/2007 | Webster, Jr. | G01S 7/4026 342/147 |
| 7,346,452 | B2 * | 3/2008 | Ford | G01C 21/165 342/357.32 |
| 2004/0119640 | A1 * | 6/2004 | Menegozzi | G01S 3/46 342/418 |
| 2008/0281555 | A1 * | 11/2008 | Godin | A61B 5/1126 702/153 |
| 2011/0285590 | A1 * | 11/2011 | Wellington | G01S 19/36 342/417 |
| 2011/0304736 | A1 * | 12/2011 | Evans | H04N 5/33 348/169 |
| 2015/0011159 | A1 * | 1/2015 | Marinov | H04B 7/18517 455/12.1 |

* cited by examiner

MOBILE TERMINAL ANTENNA ALIGNMENT USING ARBITRARY ORIENTATION ATTITUDE

RELATED APPLICATIONS

This application claims priority from U.S. provisional application entitled "Mobile Terminal Antenna Alignment Using Arbitrary Orientation Attitude", Ser. No. 61/927,322, filed 14 Jan. 2014, which is incorporated herein by reference.

TECHNICAL FIELD

The disclosed method and apparatus relates to aligning an antenna and more specifically to aligning an antenna mounted on a mobile platform to the platform.

BACKGROUND

Satellite communication systems provide a means by which data, including audio, video and various other sorts of data, can be communicated from a transmitter at one location to a receiver at another location. Satellite communication systems are currently being used on mobile platforms, such as civilian airlines and privately owned aircraft to provide entertainment and internet access to the passengers. Military platforms, such as aircraft and ships, currently use satellite communication systems to receive and transmit various types of information, including strategic and tactical information.

Satellite communication systems require an antenna to receive signals from, and transmit signals to, a satellite. The antenna typically must be pointed accurately at the satellite. A satellite antenna positioner is typically used to point the antenna at the satellite. It is common for these antenna positioners to have two axes of motion (e.g., elevation and azimuth). In the case of a system mounted on an aircraft, the elevation and azimuth that will point the antenna to the satellite can be calculated if the following information is known: (1) the location and attitude of the aircraft; and (2) the location of the satellite, assuming the relative alignment of the antenna to the body of the aircraft is known. In most commercial airliners and military aircraft, the attitude of an aircraft is determined by a position and attitude measuring device (PAMD), such as an inertial reference unit (IRU).

Such systems typically provide the attitude of the aircraft in terms of three orthogonal axes: roll, pitch, and yaw. Errors in alignment of the antenna with respect to the PAMD will cause pointing errors (i.e., the antenna will not be pointed accurately at the desired satellite when using information from the PAMD to calculate the parameters, such as azimuth and elevation, for pointing the antenna). These alignment errors can be defined as roll, pitch and yaw errors. The antenna can be "peaked" to correct for these errors for a particular orientation. Peaking involves finding the antenna direction that results in the greatest signal strength received from the satellite through the antenna. These corrections are determined within the antenna positioner. Accordingly, such corrections will be determined in the two axes of elevation and azimuth used by the antenna positioner.

While the corrections can be converted from azimuth and elevation to a three dimensional Cartesian coordinate system, a problem exists in that such corrections will only be accurate for that particular orientation of the mobile platform. Applying these corrections to the azimuth and elevation calculated for other orientations will not accurately point the antenna. In fact, applying such corrections may result in even greater pointing errors in some orientations.

It can be seen that accurately aligning the antenna to the PAMD of an aircraft is important when using the PAMD output to position a satellite antenna. However, performing the alignment poses challenges. Therefore, there is currently a need for a simple and accurate means by which to align a satellite antenna to a mobile platform, such as an aircraft frame or PAMD within an aircraft.

SUMMARY

Various embodiments of a method and apparatus for accurately aligning a satellite antenna mounted on a mobile platform are disclosed. In one embodiment of the disclosed method and apparatus, the platform is an aircraft. However, the disclosed concepts can be applied to other mobile platforms as well, such as ships, trucks, trains, automobiles, and the like. In accordance with one embodiment of the disclosed method and apparatus, the platform is placed in a first orientation, which may be arbitrarily selected for convenience. Measurements are made in the first orientation. In the case in which the platform is an aircraft, the platform can be placed in the first orientation during a pre-flight alignment procedure, or while the aircraft is undergoing ground movement (e.g., taxiing), or during flight.

The measurements are made by receiving the location of the platform and the location of a satellite of interest. The location of the platform and the satellite are used to determine a first vector $\vec{d}$ from the platform to the satellite. The first vector $\vec{d}$ is represented in coordinates defined with respect to a topocentric reference frame. An output from a Position and Attitude Measuring Device (PAMD), such as an inertial reference unit (IRU), provides the attitude of the platform. It should be noted that there may be an offset between the platform reference frame and the PAMD reference frame. However, for the purpose of this discussion, the platform reference frame is assumed to be aligned with the PAMD reference frame. Any such offset will be irrelevant, so long as the relationship between the PAMD and the antenna reference frames remains fixed. A second vector $\vec{d}'_i$ is determined by performing an alias transformation on the first vector $\vec{d}$ based on the attitude output from the PAMD to transform the first vector $\vec{d}$ from the topocentric reference frame to the second vector $\vec{d}'_i$ having coordinates defined with respect to the platform reference frame (i.e., PAMD reference frame).

In addition, an antenna control unit (ACU) peaks the antenna. The orientation of the antenna when peaked is determined based on the output from an antenna positioning motor or sensors used to assist in positioning the antenna (i.e., directing the antenna to a satellite). For example, in one embodiment in which the antenna is positioned using an antenna positioning motor having motion in azimuth and elevation, the azimuth and elevation that result in the antenna receiving the strongest signal are used as the orientation of the antenna. A third vector $\vec{d}''_i$ pointing from the antenna to the satellite represented in coordinates defined with respect to the antenna reference frame is determined based on the orientation of the antenna when peaked (i.e., the azimuth and elevation in the embodiment in which the antenna motor operates in these two axes).

The measurements are repeated for several orientations. Once measurements for an adequate number of orientations have been collected, a matrix comprising the collection of second vectors $\vec{d}'_i$ and a matrix comprising the collection of third vectors $\vec{d}''_i$ are used to determine a first rotation matrix. The first rotation matrix can then be used to determine roll, pitch and yaw offsets between the PAMD reference frame and the antenna reference frame.

A second rotation matrix is derived from the roll, pitch and yaw offsets. The second rotation matrix is used to perform an alias transformation on a vector in the PAMD reference frame to a vector in the antenna reference frame. Accordingly, a vector calculated to point from the platform to the satellite can be transformed to a vector pointing from the antenna to the satellite in the antenna reference frame. The vector in the antenna reference frame can be used to generate coordinates (i.e., azimuth and elevation) to be used in the antenna position motor to accurately point the antenna to the satellite.

BRIEF DESCRIPTION OF THE DRAWINGS

The disclosed method and apparatus, in accordance with one or more various embodiments, is described with reference to the following figures. The drawings are provided for purposes of illustration only and merely depict examples of some embodiments of the disclosed method and apparatus. These drawings are provided to facilitate the reader's understanding of the disclosed method and apparatus. They should not be considered to limit the breadth, scope, or applicability of the claimed invention. It should be noted that for clarity and ease of illustration these drawings are not necessarily made to scale.

The figures are not intended to be exhaustive or to limit the claimed invention to the precise form disclosed. It should be understood that the disclosed method and apparatus can be practiced with modification and alteration, and that the invention should be limited only by the claims and the equivalents thereof.

DETAILED DESCRIPTION

Figure 1A:
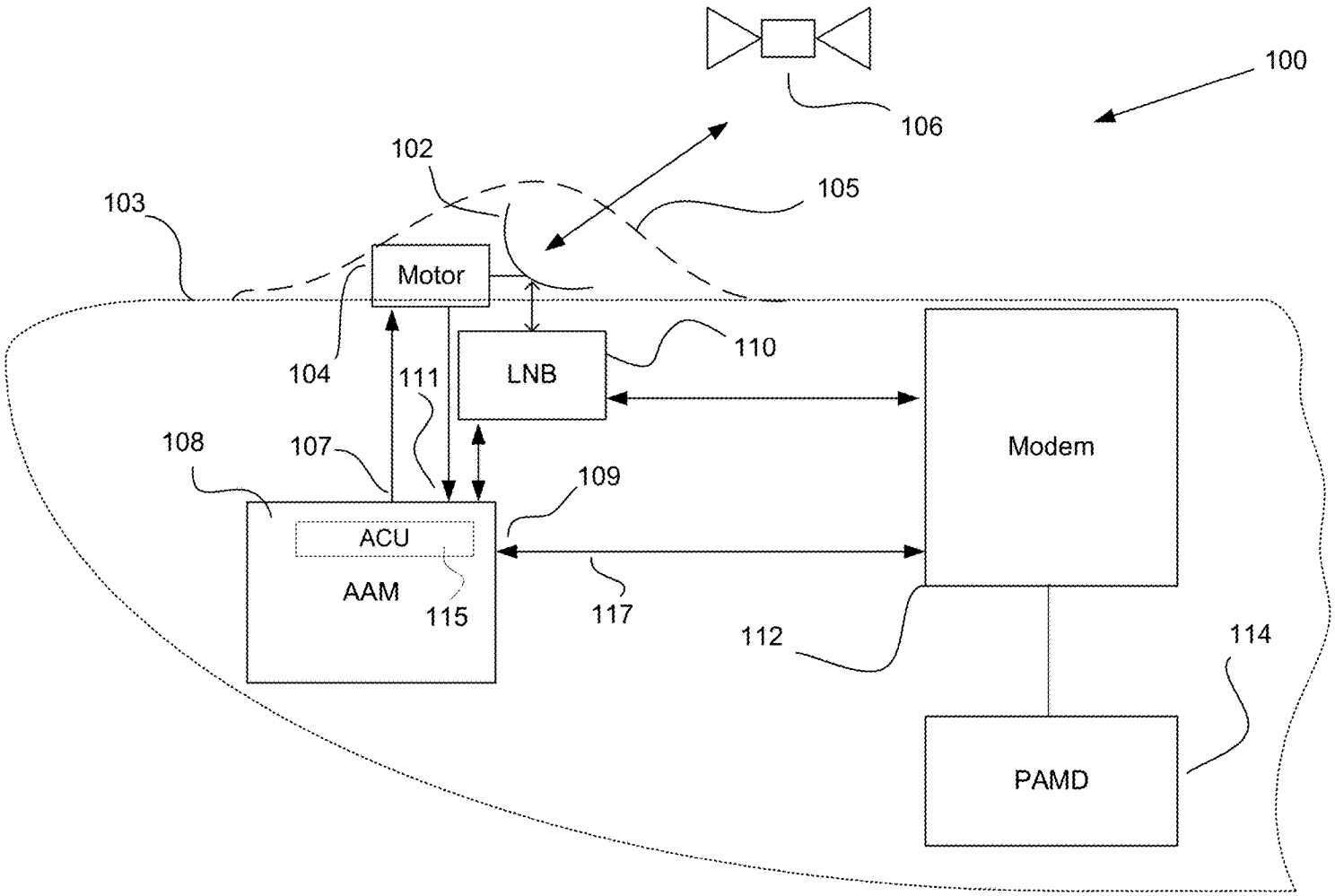
FIG. 1*a* is an illustration of the relevant components of a satellite communication system in accordance with one embodiment of the presently disclosed method and apparatus.

FIG. 1*a* is an illustration of the relevant components of a satellite communication system 100 in accordance with one embodiment of the presently disclosed method and apparatus. In the illustrated embodiment, an antenna 102 is mounted on a mobile platform. For the sake of illustration, the platform shown in FIG. 1*a* is an aircraft 103. However, it should be noted that the platform could be any mobile platform, such as a truck, automobile, ship, train or other such mobile platform.

FIG. 1*a* is intended to identify the relevant components of a system and not to accurately represent the relative location or size of the equipment within an aircraft. Furthermore, only those components that are relevant to the presently disclosed method and apparatus are depicted in FIG. 1*a* for the sake of simplicity. Accordingly, the scale and relative location of the equipment within an actual aircraft may vary significantly from what is depicted in FIG. 1*a*. Furthermore, some components that are necessary for a satellite communication system, but which are not necessary for the disclosed method and apparatus for aligning an antenna, are not shown in FIG. 1*a*.

An antenna positioning module, such as an antenna positioning motor 104 is coupled to the antenna 102 to move the antenna 102. Alternatively, the antenna positioning module is an electronically steering module that directs the antenna beam. In accordance with one embodiment of the disclosed method and apparatus, the motor 104 moves the antenna in azimuth and elevation. In an alternative embodiment, the positioning motor 104 may move the antenna in three axes or in different axes, such as yaw and pitch. An antenna alignment module AAM 108 comprising an antenna control unit (ACU) 115 provides control signals to the motor 104 through a first output port 107. In one embodiment, a radome 105 covers the antenna 102 and motor 104. Alternatively, the motor 104 may be below the antenna 102 and inside the fuselage of the aircraft. In another alternative embodiment, the antenna is connected remotely by linkage that allows the motor 104 to control the movement of the antenna 102. It will be understood by those skilled in the art that any manner by which the antenna can be positioned, including electronically steering the antenna, would be within the scope of the disclosed method and apparatus. The motor 104 or electronic steering module may provide information regarding the position of the antenna 102 back to the AAM 108 through an input port 111.

In accordance with one embodiment of the disclosed method and apparatus, signals received by the antenna 102 are coupled to a low noise block (LNB) 110. In one such embodiment, the LNB 110 amplifies the signals. In one such embodiment, the LNB also performs front end processing, such as filtering and/or frequency down-conversion. The output of the LNB 110 is coupled to a modem 112. In one such embodiment, the modem 112 measures the received power and provides an output signal 117 through an input port 109 to the AAM 108 indicating the received power. Alternatively, the received power is measured within the LNB 110 or by another component within the receive chain. Any device and manner can be used to measure the received power and would be within the scope of the disclosed method and apparatus. For the purposes of this disclosure, received power is measured to provide feedback to assist in pointing the antenna, as is discussed in greater detail below.

In accordance with one embodiment of the presently disclosed method and apparatus, an attitude determining device is present. In one such embodiment, the attitude determining device is included within a position and attitude measuring device (PAMD) 114 is present (illustrated as being on board the aircraft 103). In accordance with one embodiment of the disclosed method and apparatus, the PAMD 114 is an inertial reference unit (IRU). Alternatively, the PAMD 114 may be an inertial measurement unit (IMU) or any other device capable of providing information regarding position and attitude. It should be further noted that in one embodiment of the disclosed method and apparatus, the PAMD 114 comprises two independent devices or systems, the attitude determining device that determines attitude and a position determining device that determines position. For example, a set of gyroscopes can provide information regarding attitude. An independent global positioning system (GPS) 116 can provide information regarding position. In any case, the PAMD 114 provides the attitude and position of the aircraft 103 to the AAM 108. For the purposes of this discussion, it is assumed that the PAMD 114 is aligned with the platform (i.e., the aircraft 103). Any offset between the platform and the PAMD 114 will be irrelevant, since all measurements are made with respect to the PAMD 114, as long as the relationship between the PAMD and the antenna remain unchanged. In one embodiment, in addition to providing information that assists with pointing and alignment of the antenna 102, the PAMD 114 provides real-time information that helps the pilot navigate and operate the aircraft 103. Alternatively, two independent systems are provided. The first such system provides information used for alignment of the antenna 102 and the second for navigation. In either case, in one embodiment, the PAMD 114 used for alignment of the antenna 102 is assumed to be aligned with a topocentric frame of reference. Alternatively, the PAMD 114 is aligned with a reference frame that has a relationship with the topocentric reference frame that is either known or that can be determined. In yet another alternative embodiment, the PAMD 114 is aligned with a reference frame that has a relationship with a reference frame in which a satellite 106 can be located. In accordance with one embodiment of the disclosed method and apparatus, the attitude of the platform, the PAMD 114 and the antenna 102 remain essentially unchanged as the platform changes attitude. It will be understood that some change will occur due to flexing of the platform and the structural components of the antenna mount, etc. In cases in which the offset between the PAMD reference frame and the antenna reference frame change over time due to structural changes due to loading or aging, such differences can be accounted for by re-aligning the antenna to the PAMD using the process disclosed herein.

Figure 1B:
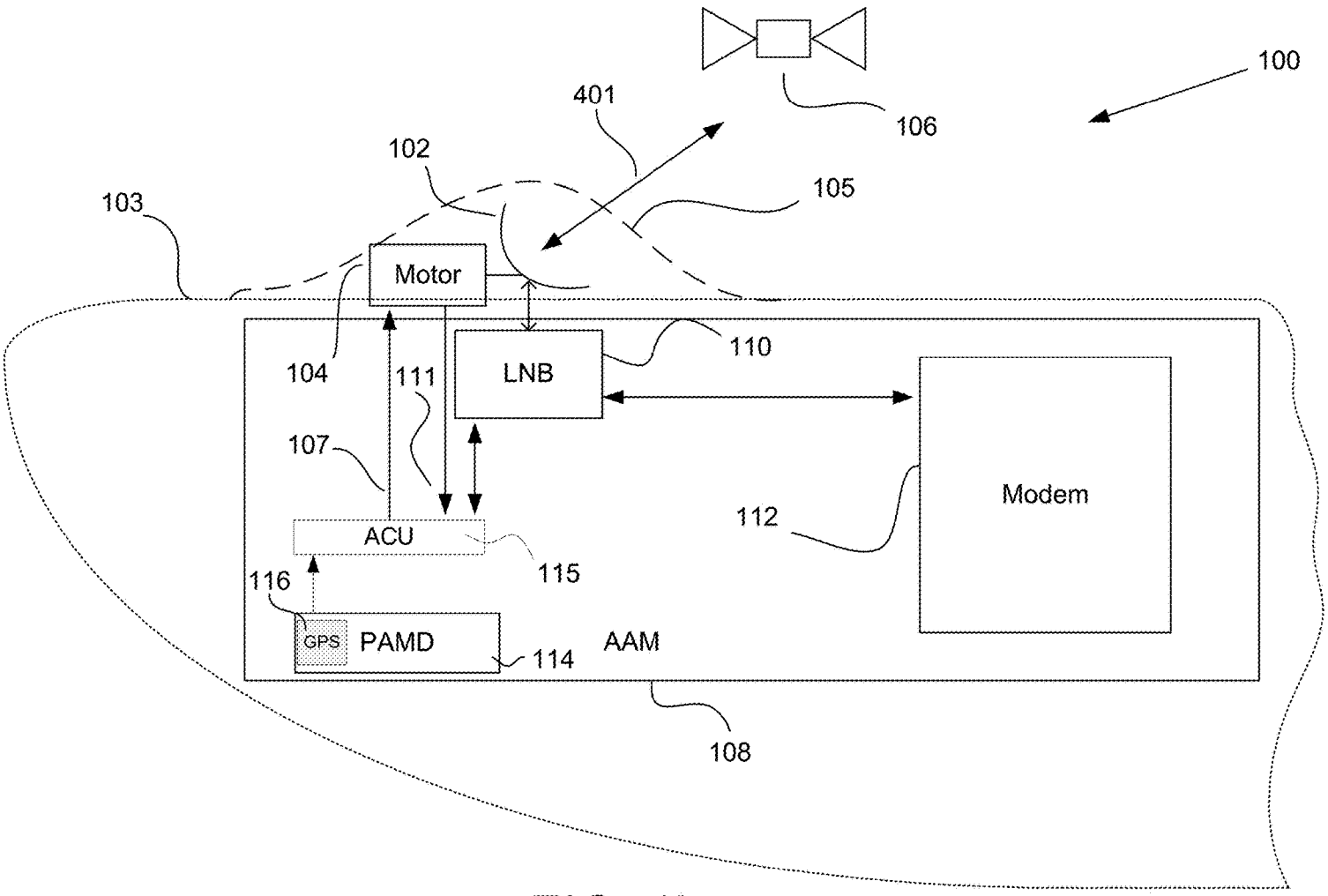
FIG. 1*b* is an illustration of an alternative embodiment of the presently disclosed method and apparatus in which a Position and Attitude Measurement Device (PAMD) is included within an Antenna Alignment Module (AAM).

The AAM 108 receives information from the PAMD 114 through an input port 109. In the embodiment shown in FIG. 1*a*, the information is provided through the modem 112. However, in an alternative embodiment, the PAMD 114 is directly connected to the AAM 108. In one such embodiment, the information is provided over a standard ARINC 429 bus. Routing the information provided by the PAMD 114 through the modem allows the connection that is otherwise required between the modem and the AAM 108 to be advantageously exploited. FIG. 1*b* illustrates an embodiment in which the LNB 110, modem 112, PAMD 114 and ACU 115, is all located within the AAM 108. Alternatively, some, but not all, of these components are located within the AAM 108. It should be noted that the functions of each of these components can be performed by others of the components as well. For example, in one embodiment of the disclosed method and apparatus, a processor within the modem 112 determines the values of some of the vectors associated with the alignment procedure. Additionally, the functions associated with the PAMD 114 can be performed by a PAMD within the AAM 108. An additional PAMD can also be provided within the platform to assist with navigation of the platform. In one embodiment, the additional PAMD also provides information that is used by the AAM 108.

Figure 2:
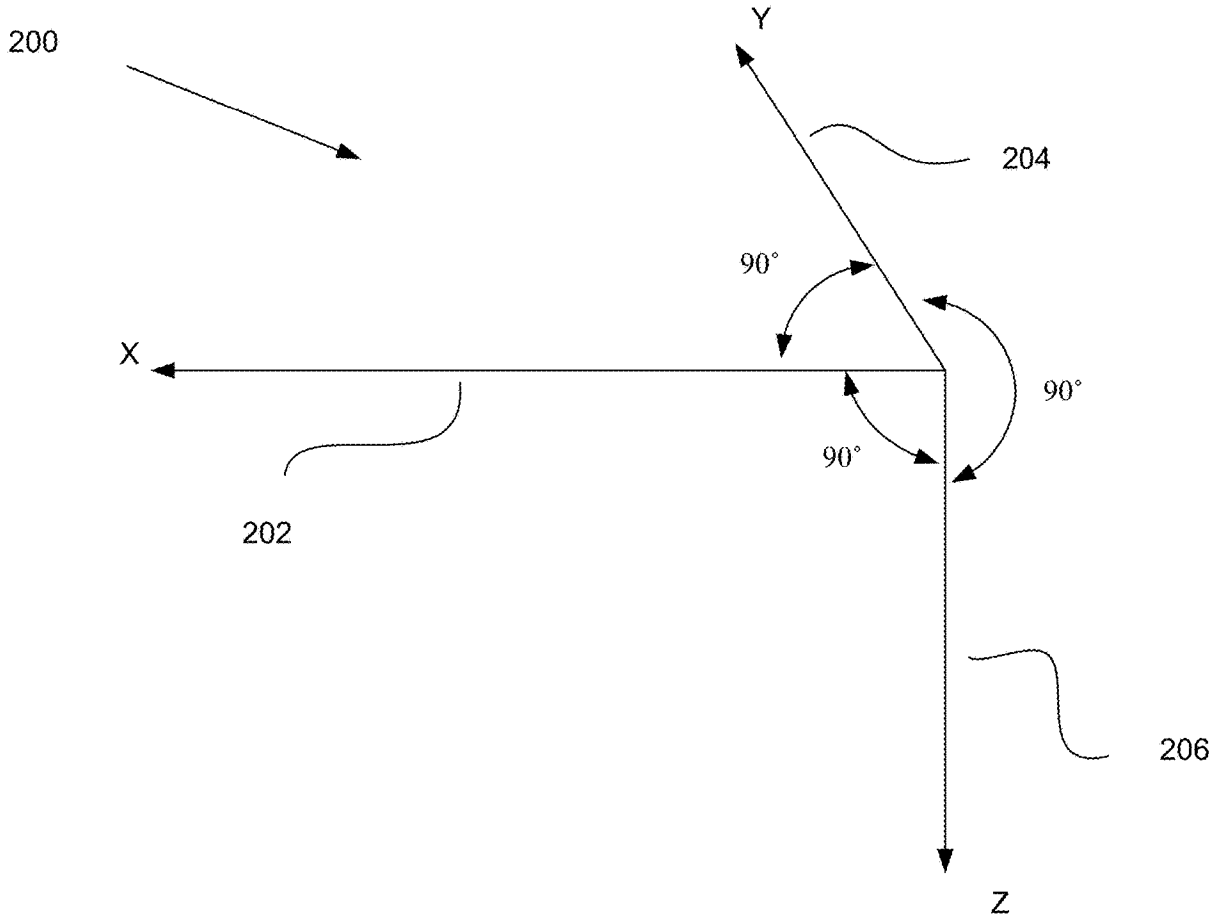
FIG. 2 is an illustration of a three-dimensional Cartesian coordinate frame set in a topocentric reference frame.

FIG. 2 is an illustration of a three dimensional Cartesian coordinate frame 200 set in a topocentric reference frame. In this example, the X axis 202 is aligned with the compass heading North, the Y axis 204 is aligned with the compass heading East and the Z axis 206 is aligned with an earth radian that emanates from the origin of the reference frame and extends through the center of the earth. This alignment is commonly known as North, East, Down (NED). Each axis is orthogonal and forms a 90 degree angle with each of the other axes. In accordance with one embodiment of the disclosed method and apparatus, the origin of the topocentric reference frame used by the PAMD 114 is the latitude and longitude of the aircraft 103. Altitude is assumed to be zero (i.e., the origin of the topocentric reference frame is at earth surface).

Figure 3A:
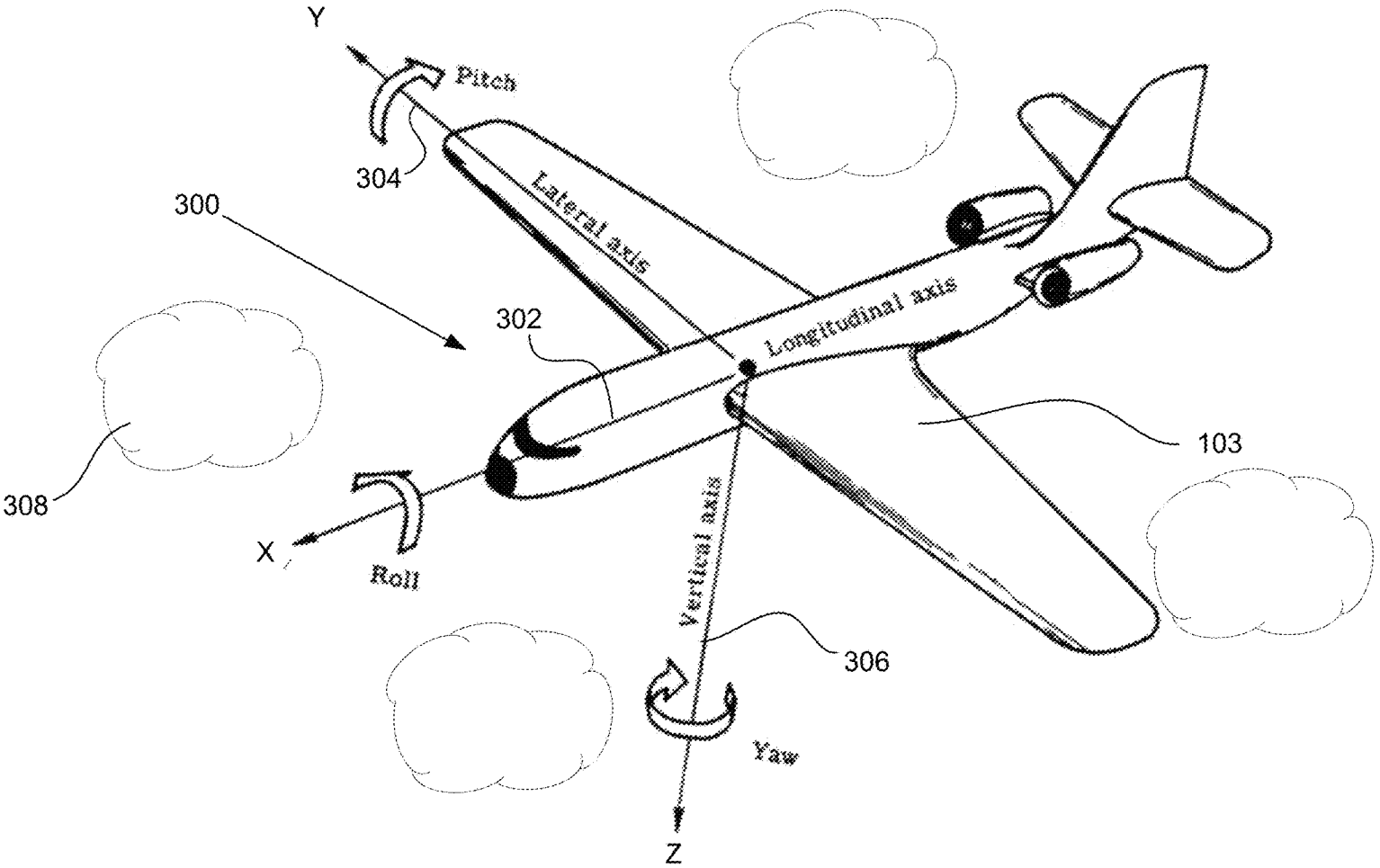
FIGS. 3*a*, 3*b* and 3*c* illustrate an aircraft and associated PAMD reference frame associated with the PAMD on board the aircraft.
Figure 3B:
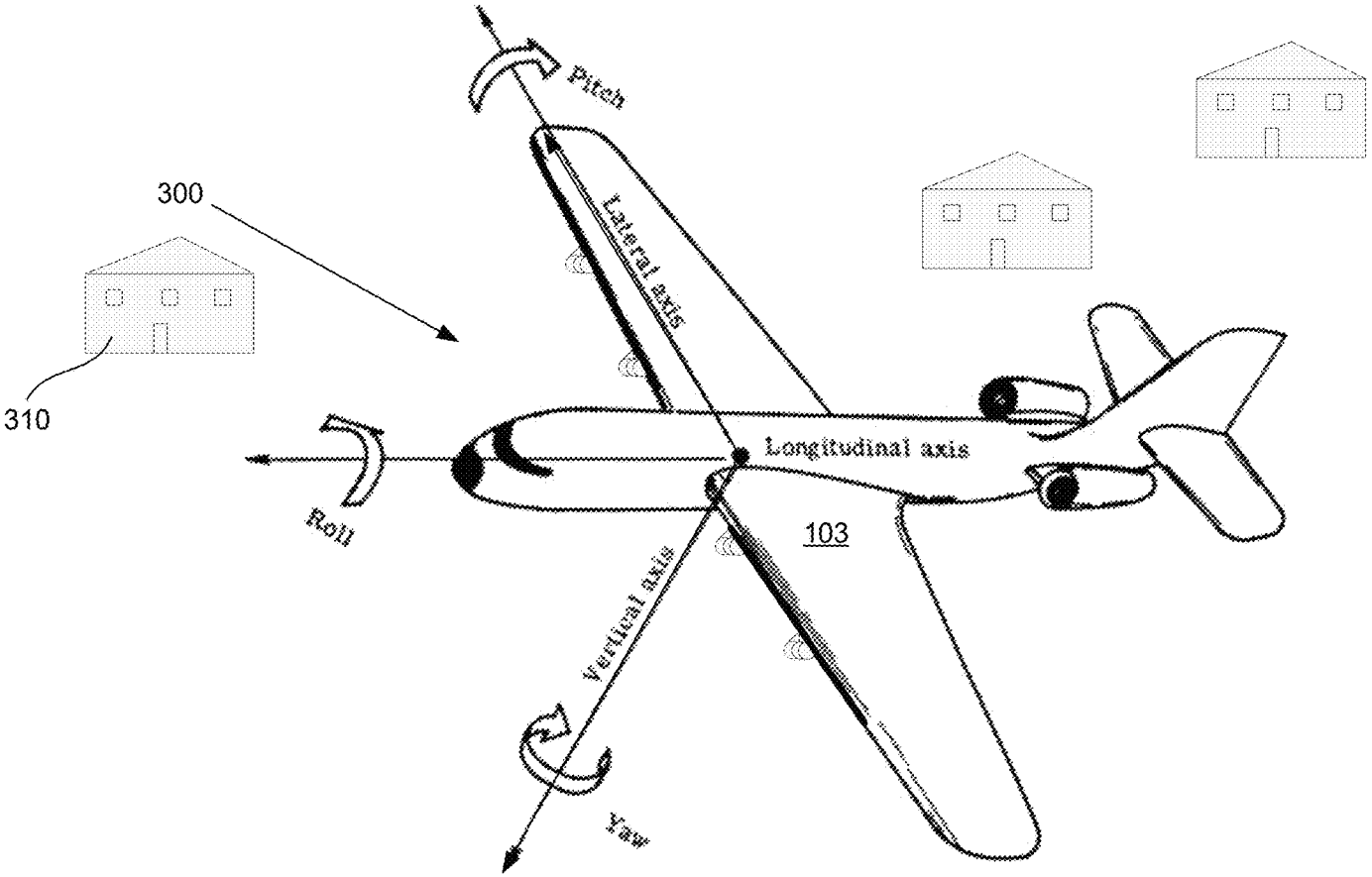
Figure 3C:
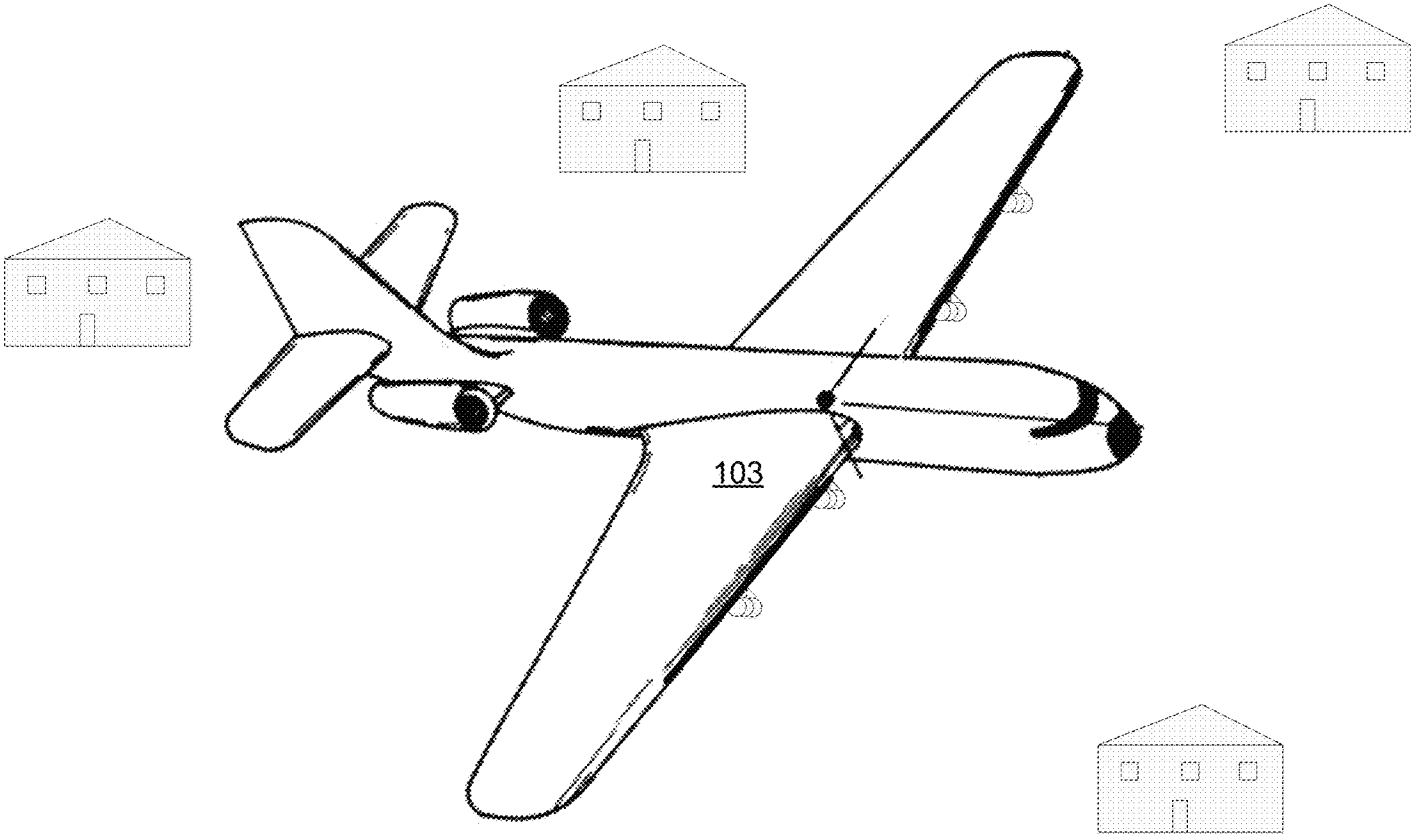

FIG. 3*a* is an illustration of the aircraft 103 in flight, as indicated by the clouds 308 depicted in the figure. An associated PAMD reference frame 300 associated with the PAMD 114 on board the aircraft 103 is also shown. In this example, the X axis of the PAMD reference frame 300 is along the longitudinal axis 302 of the aircraft 103. The Y axis is along the lateral axis 304 of the aircraft 103 The Z axis is along the vertical axis 306 of the aircraft 103. Unlike the topocentric reference frame which remains fixed in attitude with respect to earth, the PAMD reference frame 300 moves along with the aircraft 103. The attitude of the aircraft 103 is defined by the set of rotations in roll, pitch and yaw between the PAMD reference frame 300 and the topocentric reference frame 200. Roll is the rotation of the aircraft 301 about the X axis. Pitch is the rotation of the aircraft 301 about the Y axis. Yaw is the rotation of the aircraft 301 about the Z axis. FIG. 3*b* illustrates the aircraft 103 and reference frame 300 when the aircraft is on the ground, as indicated by the structures 310 depicted in the figure. FIG. 3*c* illustrates the aircraft 103 on the ground in a second orientation 180 degrees from the orientation shown in FIG. 3*b*.

In one embodiment of the disclosed method and apparatus, information indicating the attitude of the aircraft 103 is output from the PAMD 114 in the form of three angular displacements. A first angular displacement represents the rotation in roll, the second represents the rotation in pitch and the third represents the rotation in yaw.

In order to receive the satellite signals through the antenna 102 with the maximum possible signal strength, the antenna 102 must be positioned to point at a transmitting satellite 106 (similarly for transmission from the antenna 102 to the satellite 106). When attempting to point an antenna 102 at a satellite 106, a vector can be calculated from the antenna 102 to the satellite 106, assuming known values for (1) the location of the satellite 106, (2) the location of the antenna 102 and (3) the attitude of the antenna with respect to the satellite 106. All of these factors can be measured or computed. In particular, the locations of satellites are well known and available in coordinates that are typically represented in a topocentric reference frame. In accordance with one embodiment of the disclosed method and apparatus, the location of the satellite is provided to the AAM 108 from the modem 112 through the input port 109. Alternatively, the PAMD 114 is within the AAM 108. In some embodiments of the presently disclosed method and apparatus, the origin of the reference frame used to define the location of the satellite 106 will be displaced from the origin of the topocentric reference frame having an origin at the latitude and longitude of the aircraft 103.

The location of the antenna 102 can be assumed to be the location that is output by the PAMD 114 (i.e., any error due to the fact that the antenna 102 may not be exactly collocated with the PAMD 114 are assumed to be negligible and are thus ignored). With this information, a unit vector $\vec{d}$ can be calculated which points from the antenna 102 to the satellite 106. The vector $\vec{d}$ is composed of three components, dx, dy, dz, with respect to the topocentric reference frame having its origin at the latitude and longitude of the aircraft 103. If the aircraft 103 (and so the PAMD 114) is aligned with the topocentric reference frame (i.e., the aircraft 103 is pointing north with no pitch or roll with respect to the topocentric reference frame), then the azimuth and elevation of the antenna 102 can be easily calculated directly from the vector $\vec{d}$.

However, in the more general case, the aircraft 103 has an attitude that is not aligned with the topocentric reference frame. That is, the aircraft 103 has a heading other than North and may have a pitch and roll offset as well. In this case, the vector $\vec{d}$ must be transformed using an alias transformation. An alias transformation is defined as a transformation of the coordinates of a vector from a first coordinate system to a second coordinate system. The vector remains in the same place and only the coordinate system changes (i.e., the frame of reference used to represent the vector). Accordingly, a vector having coordinates defined with respect to a first reference frame can be represented as a vector having coordinates defined with respect to a second reference frame.

Figure 4:
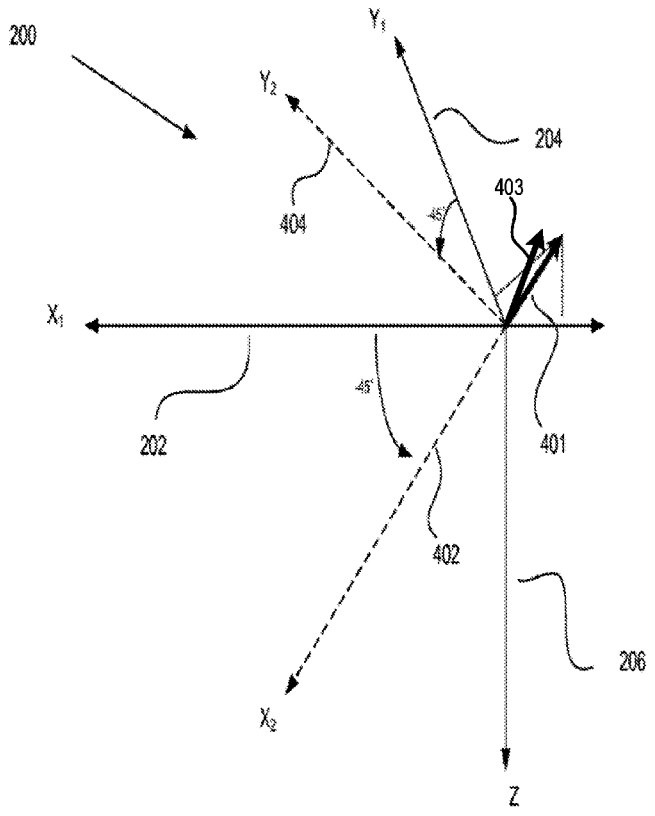
FIG. 4 is an illustration of a vector in a first reference frame comprising an $X_1$, $Y_1$, and Z axis.

FIG. 4 is an illustration of a vector 401 in a first reference frame 200 comprising an $X_1$ axis 202, a $Y_1$ axis 204, and a Z axis 206. FIG. 4 further shows a rotation of the first reference frame 200. In this example, rotating the first reference frame 200 forms a second reference frame comprising an $X_2$ axis 402, a $Y_2$ axis 404, and the same Z axis 206. In the case shown in FIG. 4, the first reference frame is rotated about only one axis (i.e., the Z axis 206) in order to simplify the example. Therefore, the Z axis 206 is common to both reference frames. In the example of FIG. 4, the vector 401 lies in the X, Y plane of both the first and second reference frames (i.e., the Z component of the vector 401 is zero in both frames of reference). In the first reference frame 200, the vector 401 has a projection to the X axis of approximately −0.707 (assuming the vector 401 to be a unit vector forming an angle of 45 degrees between the X and Y axis). The projection of the vector 401 on the Y axis is approximately 0.707. If the first reference frame 200 is rotated −45 degrees about the Z axis 206 (using the right-hand rule of thumb convention), then the vector 401 has a projection on the X axis of −1.0 and a projection on the Y axis of 0.0 in the second reference frame.

While in this example the transformation is easy to see, it is typically necessary to determine the transformation more generally. The alias transformation of a vector from a first reference frame to a second reference frame can be calculated as:

$$\vec{d}'_i = M_i \vec{d} \qquad \text{Eq. 1}$$

where $\vec{d}'_i$ is the vector 401 in the second reference frame, $\vec{d}$ is the vector 401 in the first reference frame and $M_i$ is the rotation matrix shown in Eq. 2 below. Thus, the rotation matrix $M_i$ of Eq. 2 is used to perform the alias transformation of the vector 401 from the first to the second reference frame. The index i is used to distinguish a first orientation from subsequent orientations, each orientation being referenced to the first reference frame.

$$M_i(R_i, P_i, Y_i) = \begin{bmatrix} \cos(P_i)*\cos(Y_i) & \cos(P_i)*\sin(Y_i) & -\sin(P_i) \\ \sin(R_i)*\sin(P_i)*\cos(Y_i) - \cos(R_i)*\sin(Y_i) & \sin(R_i)*\sin(P_i)*\sin(Y_i) + \cos(R_i)*\cos(Y_i) & \sin(R_i)*\cos(P_i) \\ \cos(R_i)*\sin(P_i)*\cos(Y_i) + \sin(R_i)*\sin(Y_i) & \cos(R_i)*\sin(P_i)*\sin(Y_i) - \sin(R_i)*\cos(Y_i) & \cos(R_i)*\cos(P_i) \end{bmatrix} \qquad \text{Eq. 2}$$

In the case of the example shown in FIG. 4 in which $R_i$ is 0°, $P_i$ is 0° and $Y_i$ is −45°, the rotation matrix times the vector $\vec{d}$ is equal to:

$$M_i\vec{d} = \begin{bmatrix} \cos(-45) & \sin(-45) & 0 \\ -\sin(-45) & \cos(-45) & 0 \\ 0 & 0 & 1 \end{bmatrix} \begin{bmatrix} -.707 \\ .707 \\ 0 \end{bmatrix} = \qquad \text{Eq. 3}$$

$$\begin{bmatrix} .707 & -.707 & 0 \\ .707 & .707 & 0 \\ 0 & 0 & 1 \end{bmatrix} \begin{bmatrix} -.707 \\ .707 \\ 0 \end{bmatrix} = \begin{bmatrix} -.5 + -.5 \\ -.5 + .5 \\ 0 \end{bmatrix} = \vec{d}'_i$$

If both the location of the satellite 106 and the antenna 102 were known and the antenna 102 were well aligned to the PAMD coordinate frame, the vector from the antenna 102 to the satellite 106 could be easily calculated by applying Eq. 2 and using the roll, pitch and yaw output from the PAMD 114. However, when the antenna 102 is mounted on an aircraft 103, as is the case in one embodiment of the disclosed method and apparatus, the attitude of the aircraft 103 (and so, typically the PAMD 114) will typically be offset from the antenna frame of reference. That is, the antenna 102 typically will not be perfectly aligned with the PAMD 114.

Calculating the azimuth and elevation of the antenna required to point the antenna 102 at the satellite 106 requires the antenna 102 to be aligned with the PAMD 114. In accordance with one procedure for aligning the antenna 102 to the PAMD 114, the aircraft 103 must be taken onto as level a surface as possible. The aircraft is oriented so that the output of the PAMD 114 in yaw (heading) is 0° (i.e., North). The antenna 102 is then peaked to determine the azimuth and elevation that yields the strongest signal from the satellite 106. Additional measurements are made by physically repositioning the aircraft 103 to headings of 90°, 180° and 270° based on heading readings from the PAMD 114. If the aircraft is resting on perfectly flat terrain, then the azimuth and elevation measurements will directly translate to the roll, pitch and yaw offsets between the antenna reference frame and the topocentric reference frame. However, this method requires that the aircraft 103 be perfectly level and that it be oriented very precisely to 0°, 90°, 180° and 270°.

Alternatively, an alignment procedure according to the disclosed method and apparatus can be used in which the aircraft 103 is initially in any orientation. In accordance with this procedure, a first vector $\vec{d}$ from the antenna 102 to the satellite 106 is calculated in the topocentric reference frame.

Since the location of the satellite 106 and the location of the aircraft 103 are both known in the topocentric reference frame, this is easily accomplished. For the purpose of determining the first vector $\vec{d}$, the difference between the location of the aircraft 103 and the location of the antenna 102 is considered negligible. Any difference in the location of the origin of the topocentric reference frame used to define the location of the satellite 106 and the origin of the reference frame used to define the location of the aircraft 103 (i.e., the location output of the PAMD 114) is easily managed by a simple translation of the coordinates from one reference frame to the other.

Next, the first vector $\vec{d}$ is transformed by an alias transformation to the PAMD reference frame to determine a second vector $\vec{d}'_i$. This is done using the alias transformation noted above in Eq. 1. The first vector $\vec{d}$ is multiplied with the rotation matrix $M_i$ ($R_i$, $P_i$, $Y_i$), of Eq. 2, where $R_i$, is the amount of roll as indicated by the PAMD 114, $P_i$, is the amount of pitch as indicated by the PAMD 114, and $Y_i$ is the amount of yaw as indicated by the PAMD 114.

If the antenna 102 is aligned with the PAMD 114, the second vector $\vec{d}'_i$ in the PAMD reference frame could be directly converted to azimuth and elevation. However, assuming there is a rotational offset between the reference frame of the PAMD 114 and the reference frame of the antenna 102, directly converting the vector in the PAMD reference frame to an azimuth and elevation will result in an error in the calculation of the azimuth and elevation of the antenna 102. The result is that the antenna 102 will not be pointed directly at the satellite 106. The error can be measured by peaking the antenna 102 and reading the resulting azimuth and elevation directly from the antenna positioning motor 104 or a sensor on the antenna 102. However, correcting the error in this manner is only valid for that particular orientation.

In order to provide a more general solution that will be valid in all orientations, the following method and apparatus is disclosed for providing a best fit rotation matrix between the PAMD reference frame and the antenna reference frame.

In accordance with one embodiment of the disclosed method and apparatus, the antenna 102 is peaked to determine the azimuth and elevation setting of the positioning motor 104 that results in the maximum signal strength being received in a signal from the satellite 106 with the aircraft in a first orientation. Signal strength can be determined based on the amplitude, signal to noise ratio (SNR), amount of received power, or other such metric. In accordance with one embodiment, the azimuth and elevation are determined by the control signals provided to the antenna positioning motor 104. Alternatively, the azimuth and elevation are read directly from the motor 104. In an alternative embodiment, the azimuth and elevation are read from an antenna position sensor (not shown) coupled to the antenna 102 or to the antenna positioning motor 104.

In accordance with one embodiment of the disclosed method and apparatus, a step track technique is used to "peak" the antenna. In one such step track peaking scheme, the antenna 102 is positioned roughly toward the satellite 106. This is done using a rough estimate of the pointing elevation and azimuth to be applied to the motor 104. In one embodiment of the disclosed method and apparatus, the offset between the PAMD 114 reference frame and the antenna 102 will not be so great that the satellite signal is not detectable. Therefore, in accordance with one embodiment, the azimuth and elevation calculated under the assumption that there is no offset between the PAMD reference frame and the antenna reference frame is a sufficiently accurate estimate at which to begin the peaking procedure.

A measurement is made of the power received through the antenna. The position of the antenna 102 is then changed in elevation by one "step". The AAM 108 directs the antenna 102 to implement the peaking technique based on the received power measurements provided from the modem 112. In an alternative embodiment, the received power is measured by a device other than the modem 112. It will be understood by those skilled in the art that a device placed essentially anywhere along the receive chain can be used to measure the received power.

For example, if the amount of received power drops after changing the elevation of the antenna 102, the antenna 102 is moved in the opposite direction. In one embodiment, the antenna 102 moves by two steps. If the amount of received power increases, the antenna is moved another step further in that direction. Another power measurement is made. Each time the amount of receive power increases, the antenna is moved another "step" in the same direction. Upon measuring a drop in the power, the antenna direction is reversed and moved one step back. Once the peak power measurement for elevation has been detected, the antenna begins a similar search for the peak in azimuth. If the initial azimuth position was not the peak, then the search in elevation is repeated. If the antenna was not at the peak elevation, then the search for the peak in azimuth is again repeated. This process will continue until both the elevation and the azimuth are at the peak received power.

It will be clear to those skilled in the art that this is a simplistic step track peaking algorithm. Many modifications to this procedure can be implemented to improve the likelihood that the antenna is at the best pointing elevation and azimuth. Furthermore, other peaking techniques can be employed, such as, but not limited to, one technique known commonly as conical scan (conscan).

In addition to determining the azimuth and elevation of the antenna 102 at peak for the first orientation of the aircraft 103, an attitude reading from the PAMD 114 is taken. In accordance with one embodiment of the disclosed method and apparatus, the aircraft 103 is positioned in various additional orientations. In one embodiment of the disclosed method and apparatus, the additional orientations are achieved by rotating the aircraft on the ground. Alternatively, the additional orientations could be achieved by a relative change in orientation with respect to the satellite, such as using a different satellite with the aircraft remaining in a fixed orientation with respect to the earth. In one case in which the aircraft is moved, the heading of the aircraft 103 is changed for each additional orientation. This can be done by taxiing the aircraft or towing the aircraft to move the aircraft to the new orientation. In yet another embodiment, the aircraft 103 can be in flight during the procedure. Accordingly, as the aircraft 103 maneuvers over the course of the flight, the orientation will change, allowing additional measurements to be made. In one such embodiment, the rate of change of the attitude output from the PAMD 114 is determined and used to estimate the attitude of the aircraft 103 at particular times when the antenna 102 is peaked. For example, a determination of the attitude of the platform is made at a first time prior to the aircraft being in the first orientation (i=1) (i.e., the first orientation at which the antenna 102 is peaked). In addition, a determination as to the rate of change of the attitude of the aircraft 103 is made at the first time. A determination is then made as to the attitude of the aircraft 103 at a second time when the aircraft is in the first orientation. The determination is made from the attitude and rate of change of the aircraft 103 determined at the first time. Accordingly, from the attitude and the rate of change in the attitude at a first time, an extrapolation can be made to determine the attitude at a second time that occurs either before or after the first time. For each particular orientation, the antenna 102 is peaked to determine the azimuth and elevation that results in the highest received signal level. The attitude output of the PAMD 114 is associated with the azimuth and elevation for that particular orientation. The azimuth and elevation at each orientation are converted to a third vector $\vec{d}''_i$ 403 in a Cartesian coordinate system in the antenna reference frame using the following relationship, where $\alpha$ is azimuth and $\varepsilon$ is elevation:

$$d''_{ix}=\cos\varepsilon_i\cos\alpha_i$$

$$d''_{iy}=\cos\varepsilon_i\sin\alpha_i$$

$$d''_{iz}=-\sin\varepsilon_i \qquad \text{Eq. 4}$$

Accordingly, for each attitude there is a first vector $\vec{d}$ determined by the location of the platform 103 and the location of the satellite 106 and represented in coordinates defined with respect to the first reference frame (i.e., the topocentric reference frame). In addition, there is a second vector $\vec{d}'_i$ represented by coordinates defined with respect to the second reference frame (i.e., PAMD reference frame) and a third vector $\vec{d}''_i$ represented by coordinates defined with respect to the third reference frame (i.e., antenna reference frame). The collection of second vectors $\vec{d}'_i$ forms a first matrix $\overline{D}'$ and the collection of third vectors $\vec{d}''_i$ forms a second matrix $\overline{D}''$. If each collection of second and third vectors has no measurement noise or other source of error or inconsistency, then the first matrix is related to the second by the following equation, where T is a rotation matrix:

$$\overline{D}''=T\overline{D}' \qquad \text{Eq. 5}$$

Once a sufficient number of measurements for $\vec{d}'_i$ and $\vec{d}''_i$ have been gathered, the rotation matrix T can be solved. By solving for T, the general transformation from the PAMD reference frame to the antenna reference frame can be calculated (i.e., the offset in each of the three axes, roll, pitch and yaw can be determined and used to calculate an alias transformation). Thus, the output of the PAMD 114 can be used to calculate the azimuth and elevation needed to point the antenna 102 to the satellite 106.

Solving for T matches the form of Wahba's Problem. There are several ways known to solve Wahba's Problem. One way is to use Singular Value Decomposition to determine the pseudoinverse of the collection of vectors $\overline{D}'$ in the PAMD reference frame. By multiplying each side of equation Eq. 5 by the pseudoinverse $\overline{D}'^{+}$ of $\overline{D}'$, the following equations result:

$$\overline{D}''=T\overline{D}'$$

$$\overline{D}''\overline{D}'^{+}=T\overline{D}'\overline{D}'^{+}$$

$$T=\overline{D}''\overline{D}'^{+} \qquad \text{Eq. 6}$$

The pseudoinverse can be calculated by using the elements of the singular value decomposition (SVD) of $\overline{D}'$.

$$\overline{D}'=USV^{*}$$

$$\overline{D}'^{+}=VS^{+}U^{*} \qquad \text{Eq. 7}$$

The pseudoinverse of S may be computed by taking the transpose of the matrix formed with diagonal elements equal to the reciprocal of the diagonal elements of S. For a collection of measurements ($\overline{D}''$, $\overline{D}'^{+}$) that are noisy or that have other errors, use of the pseudoinverse will produce a least-squares estimate of the rotation.

$$\hat{T}=\overline{D}''\overline{D}'^{+}, \text{ where } \hat{T} \text{ is the least squares estimate.} \qquad \text{Eq. 8}$$

The elements of $\hat{T}$ may be used to derive the roll, pitch and yaw offsets to the vector $\vec{d}'_i$ output from the PAMD 114 using the relationships of Eq. 9 and Eq. 10. $\hat{T}$ is interpreted as the product of Roll, Pitch, and Yaw rotations. The composite rotation matrix is given as:

$$T(R_0, P_0, Y_0)=\begin{bmatrix} r_{11} & r_{12} & r_{13} \\ r_{21} & r_{22} & r_{32} \\ r_{31} & r_{32} & r_{33} \end{bmatrix}=\begin{bmatrix} \cos(P_0)*\cos(Y_0) & \cos(P_0)*\sin(Y_0) & -\sin(P_0) \\ \sin(R_0)*\sin(P_0)*\cos(Y_0)-\cos(R_0)*\sin(Y_0) & \sin(R_0)*\sin(P_0)*\sin(Y_0)+\cos(R_0)*\cos(Y_0) & \sin(R_0)*\cos(P_0) \\ \cos(R_0)*\sin(P_0)*\cos(Y_0)+\sin(R_0)*\sin(Y_0) & \cos(R_0)*\sin(P_0)*\sin(Y_0)-\sin(R_0)*\cos(Y_0) & \cos(R_0)*\cos(P_0) \end{bmatrix} \qquad \text{Eq. 9}$$

From Eq. 9, one can see that the solutions to the Roll, Pitch and Yaw rotations are:

$$Y_0=\tan^{-1}(r_{12}/r_{11})$$

$$P_0=\tan^{-1}(-r_{13}/\sqrt{r_{23}^2+r_{33}^2})$$

$$R_0=\tan^{-1}(r_{23}/r_{33}) \qquad \text{Eq. 10}$$

A vector that is initially in the PADM reference frame (i.e., a vector derived in the topocentric reference frame and translated to the PADM reference frame) can be further transformed by an alias transform to the antenna reference frame using knowledge of the roll, pitch and yaw rotations provided in Eq. 10.

Figure 5:
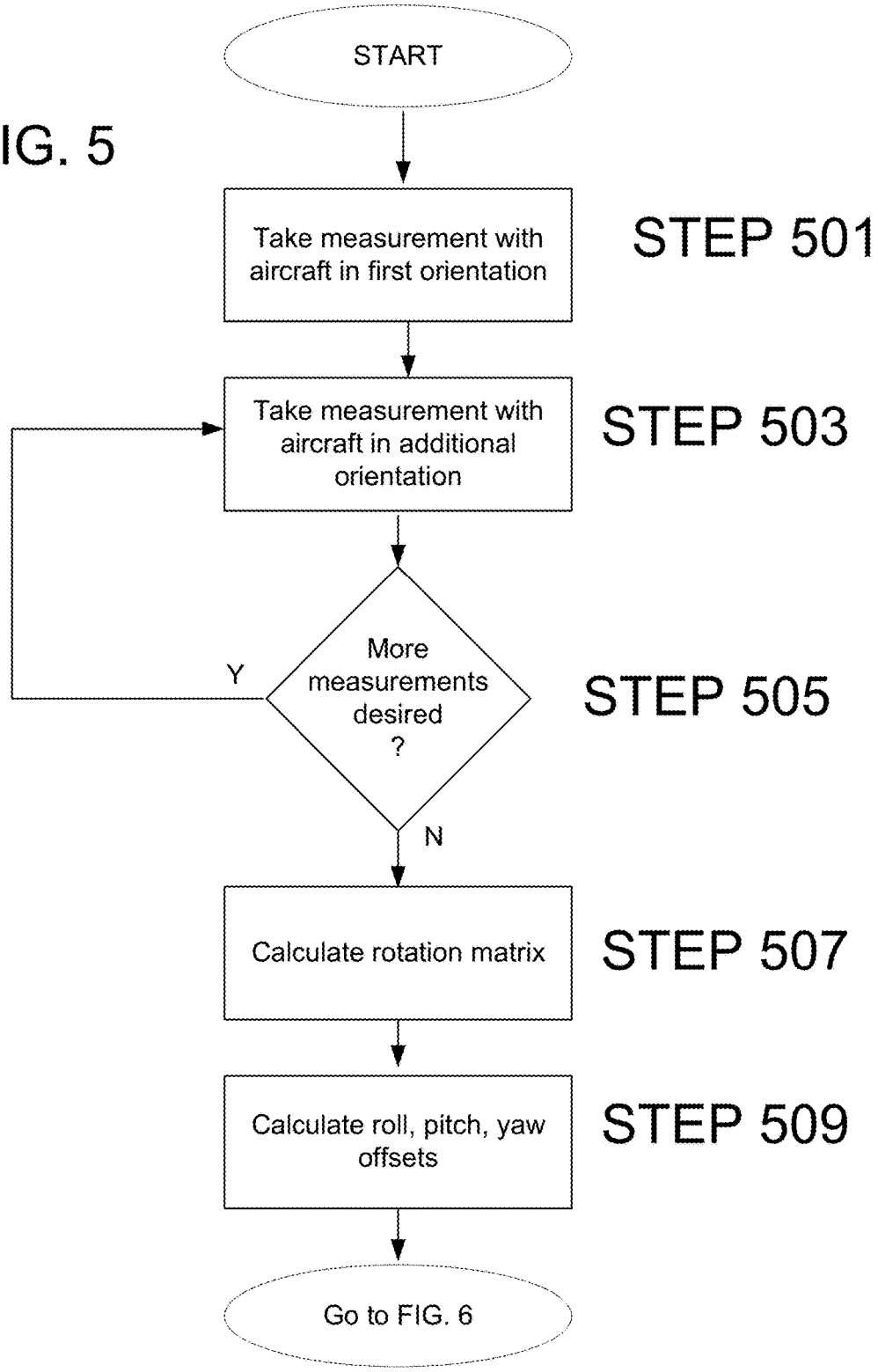
FIG. 5 is a simplified flow chart of the procedure used in accordance with one embodiment of the disclosed method and apparatus for determining the roll, pitch and yaw rotational offsets between an antenna and a positioning and attitude measurement device (PAMD) mounted in an aircraft.

FIG. 5 is a simplified flow chart of the procedure used in accordance with one embodiment of the disclosed method and apparatus for determining the roll, pitch and yaw rotational offsets between an antenna 102 and a PAMD 114 mounted in an aircraft.

In STEP 501, an initial measurement is made with the aircraft 103 in a first orientation. Taking the initial measurement includes having a processor within the AAM 108 determine a first vector $\vec{d}$. The first vector $\vec{d}$ is represented using coordinates defined with respect to a first reference frame (i.e., a topocentric reference frame). The first vector $\vec{d}$ is determined from the location of the aircraft 103 and the location of the satellite 106. In accordance with one embodiment of the disclosed method and apparatus, both the location of the aircraft 103 and the location of the satellite 106 are represented by coordinates defined with respect to a first reference frame (e.g., a topocentric reference frame). In an alternative embodiment, the determination of the first vector can be done by a processor that is not on board the aircraft. Information regarding the location of the aircraft 103 and the location of the satellite 106 are provided to such a processor.

The process of taking the initial measurement also includes the AAM 108 using information from the PAMD 114 indicating the attitude of the aircraft with the aircraft 103 in the first orientation. The information from the PAMD 114 is represented with coordinates defined with respect to a first reference frame. The processor within the PAMD 114 determines a second vector $\vec{d}'_i$ by performing an alias transformation on the first vector $\vec{d}$. The alias transformation transforms the representation of the first vector $\vec{d}$ from coordinates defined with respect to the first reference frame to coordinates defined with respect to a second reference frame (i.e., the PAMD reference frame). The transformation is performed based on the relative rotation of the second reference frame with respect to the first reference frame. The relative rotation is determined by the attitude of the aircraft 103 in the first orientation (see Eq. 1 above). The attitude of the aircraft is provided by the PAMD 114. In one embodiment, the transformation is performed within the AAM 108. In an alternative embodiment, the transformation is performed by a processor that is not on board the aircraft 103. Information necessary to perform the transformation is provided to such a process to enable the transformation to be performed.

It should be noted that the first vector $\vec{d}$ does not take into account the orientation of the aircraft 103, but is determined based only on the location of the aircraft 103 and the location of the satellite 106. Therefore, in the case in which the aircraft 103 remains at the same location for each orientation, there is no index i associated with the first vector $\vec{d}$. However, if the location of the aircraft or the satellite changes from one orientation to another, the change in location can be taken into account. In that case, the first vector $\vec{d}$ would be represented as $\vec{d}_i$ to indicate the value of the first vector at each orientation i.

In addition, during the initial measurement, the processor records the azimuth and elevation of the antenna 102 when the antenna 102 is directed at the satellite 106. In accordance with one embodiment of the disclosed method and apparatus, the antenna 102 is directed at the satellite 106 by peaking the antenna 102 to receive the strongest signal possible from the satellite 106. In one embodiment of the disclosed method and apparatus, information regarding the attitude of the antenna 102 is provided to the AAM 108. For example, in one embodiment of the disclosed method and apparatus, the azimuth and elevation of the positioning motor 104 that results in the antenna 102 receiving the strongest signal from the satellite 106 is provided to the AAM 108. In another embodiment in which the antenna is electronically steered, the attitude of the antenna 102 is the direction of the electronic bore sight or information from which the direction of the antenna bore sight can be derived. Based on the information received by the AAM 108, the processor within the AAM 108 determines a third vector $\vec{d}''_i$ that points from the antenna 102 to the satellite 106. The third vector $\vec{d}''_i$ is represented in Cartesian coordinates defined with respect to a third reference frame (i.e., the antenna reference frame). In an alternative embodiment, the attitude of the antenna is provided to a processor that is not on-board the aircraft 103. In accordance with such an embodiment, the third vector $\vec{d}''_i$ is determined by such a processor.

An additional measurement is taken with the aircraft 103 in a second orientation (STEP 503). In similar fashion to the initial measurement, the additional measurement is taken by peaking the antenna 102, determining the antenna azimuth and elevation and recording the output of the PAMD 114 at the second orientation and determining first, second and third vectors $\vec{d}_2$, $\vec{d}_2'$, $\vec{d}_2''$. Note that for the case in which the aircraft 103 remains essentially in the same location, but only changes attitude from one orientation to another, the value $\vec{d}=\vec{d}_1=\vec{d}_2=\vec{d}_i$, for all i orientations.

A determination is made as to whether enough measurements have been taken (STEP 505). If more measurements are desired, then the process repeats STEP 503 with the aircraft 103 in different orientations. It should be noted that in accordance with one embodiment of the disclosed method and apparatus, the particular orientations at which measurements are taken are essentially arbitrary. In addition, the particular number of measurements to be made will depend upon the desired accuracy. In accordance with one embodiment, eight measurements are made at various orientations distributed approximately evenly about the yaw axis 306 of the aircraft 103 (see FIG. 3). Alternatively, various factors are used to influence the selection of orientations at which to take each of the measurements.

One such factor is the relative deviation from the other orientations at which measurements have been (or are to be) taken. In some embodiments, measurements are taken at orientations that are spaced relatively evenly over the 360° of rotation possible in each axis (roll, pitch and yaw). In other embodiments, measurements are taken at relatively arbitrary orientations during operation of the aircraft 103, including while taxiing, or in flight, or both. The measurements may be taken over a span of time. It should be noted that a reasonably accurate determination of the offsets in roll, pitch and yaw between the reference frame of the antenna 102 and the aircraft 103 (or PAMD 114) can be made based on orientations resulting from rotating the aircraft 103 about only one axis, such as yaw. The offsets can be determined initially prior to operation of the satellite communication system, early in the operation of that system, or at periodic intervals during operation. In one embodiment in which offsets are updated periodically, the updates can be used to learn and correct minor changes in alignment over time, including changes in the frame of the aircraft, differing conditions (e.g., when the aircraft is on landing gear and when in the air, when the aircraft has differing loads, etc.).

As noted above, an alignment procedure may be performed in which the aircraft 103 is placed in 8 different orientations, each orientation having a heading spaced evenly around the 360° of the compass. The roll and pitch of the aircraft 103 need not be tightly controlled. Accordingly, in one such embodiment, the aircraft 103 is turned to each compass heading at which a measurement is to be taken. In one embodiment of the disclosed method, the particular orientations selected are not critical, allowing for a relatively fast and simply procedure to be implemented for determining the offsets in roll, pitch and yaw between the reference frame of the antenna 102 and the aircraft 103 (or PAMD 114).

Once a sufficient number of measurements (i.e., vectors $\vec{d}'$, $\vec{d}''$) have been collected, a composite rotation matrix $\hat{T}$ is calculated based on the relationships shown above in Eq.

5 through Eq. 8 (STEP 507). The roll, pitch and yaw offsets of the antenna reference frame with respect to the PAMD reference frame are then calculated based on the values presented in the composite rotation matrix $\hat{T}$ (STEP 509). In one embodiment of the disclosed method and apparatus, the calculation of the composite rotation matrix $\hat{T}$ is made by a processor that is not on-board the aircraft 103. The resulting roll, pitch and yaw offsets are then transmitted back to the aircraft 103 to be used to direct an antenna 102 or they are used to perform a correction to the antenna positioning information and then transmitted to the aircraft 103.

Figure 6:
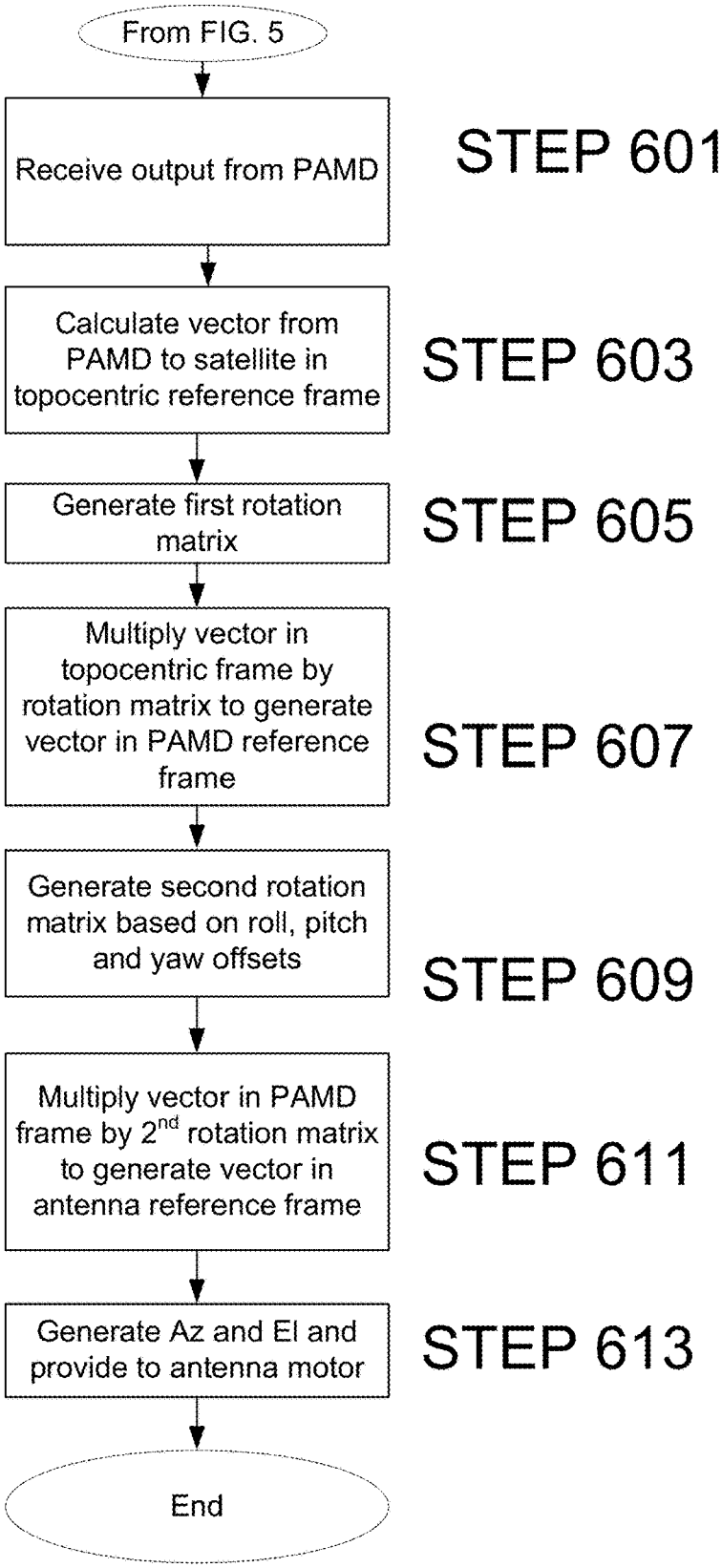
FIG. 6 is a simplified flow chart of a procedure for using the calculated roll, pitch and yaw offsets to direct an antenna at a satellite.

FIG. 6 is a simplified flow chart of a procedure for using the calculated roll, pitch and yaw offsets determined from the first, second and third vectors of FIG. 5 to direct an antenna at a satellite. Initially, the output of the PAMD 114 is received (STEP 601). The output of the PAMD 114 includes the location and attitude of the PAMD 114 in coordinates defined with respect to the PAMD reference frame. From the location of the PAMD 114 and the location of the satellite 106, a fourth vector $\vec{d}$ from the PAMD 114 to the satellite 106 can be calculated in coordinates defined with respect to the topocentric reference frame (STEP 603). An alias transformation is then performed on the fourth vector $\vec{d}$ to transform the coordinates of the vector $\vec{d}$ to the PAMD reference frame. The alias transformation is performed by applying Eq. 2 to the attitude information provided from the PAMD 114 to generate a first rotation matrix $M_i$ (STEP 605).

The vector $\vec{d}$ represented by coordinates defined with respect to the topocentric reference frame is then multiplied by the first rotation matrix $M_i$. The result is a fifth vector $\vec{d}'_i$ that points from the PAMD 114 to the satellite 106. The fifth vector $\vec{d}'_i$ is represented using coordinates defined with respect to the PAMD reference frame (STEP 607).

A second rotation matrix $\hat{T}$ is generated (STEP 609) by applying the roll, pitch and yaw offsets determined in STEP 509 of FIG. 5 to Eq. 9. The fifth vector $\vec{d}'_i$ is then multiplied by the second rotation matrix $\hat{T}$ to transform coordinates of the fifth vector to the antenna reference frame (STEP 611). The result is a sixth vector $\vec{d}''_i$ that points from the antenna 102 to the satellite 106 represented in Cartesian coordinates defined with respect to the antenna reference frame. The sixth vector $\vec{d}''_i$ is then converted to coordinates represented with respect to azimuth and elevation. The azimuth and elevation of the vector $\vec{d}''_i$ are then provided to the positioning motor 104 to point the antenna 102 to the satellite 106 (STEP 613).

It should be noted that in addition to the offsets in roll, pitch and yaw, a constant error in the elevation positioner may exist which produces an error in the elevation and azimuth determined by the procedure of FIG. 5 and FIG. 6. In accordance with one embodiment of the disclosed method and apparatus, it is desirable to account for this error as well. One source of such a constant elevation error is a misalignment of a motor stop in the positioning motor 104. Such a constant elevation error introduces a translation error. The translation error comes from the fact that the elevation offset will corrupt the collection of measurements used to derive the vector $\vec{d}''_i$. As noted above, the vector $\vec{d}''_i$ points from the antenna 102 to the satellite 106 in Cartesian coordinates in the antenna reference frame.

One way to estimate the error in the elevation measurements made when the antenna is peaked to the satellite is to multiply the vector $\vec{d}''_i$ by the transpose of an orthogonalized version of $\hat{T}$ and further by the transpose of the rotation matrix $M_i$. Accordingly, the error in elevation measurements, $\tilde{w}_i$ is:

$$\tilde{w}_i = M_i^T \hat{T}^T \vec{d}''_i \qquad \text{Eq. 11}$$

Orthogonalizing the matrix $\hat{T}$ effectively strips out the elevation offset information from the matrix $\hat{T}$. One way to orthogonalize the matrix is to compute the roll, pitch and yaw offsets. The roll, pitch and yaw offsets are then used to construct a rotation matrix as follows:

$$\tilde{T}(R_0, P_0, Y_0) = \begin{bmatrix} r_{11} & r_{12} & r_{13} \\ r_{21} & r_{22} & r_{32} \\ r_{31} & r_{32} & r_{33} \end{bmatrix} = \begin{bmatrix} \cos(P_0)*\cos(Y_0) & \cos(P_0)*\sin(Y_0) & -\sin(P_0) \\ \sin(R_0)*\sin(P_0)*\cos(Y_0) - \cos(R_0)*\sin(Y_0) & \sin(R_0)*\sin(P_0)*\sin(Y_0) + \cos(R_0)*\cos(Y_0) & \sin(R_0)*\cos(P_0) \\ \cos(R_0)*\sin(P_0)*\cos(Y_0) + \sin(R_0)*\sin(Y_0) & \cos(R_0)*\sin(P_0)*\sin(Y_0) - \sin(R_0)*\cos(Y_0) & \cos(R_0)*\cos(P_0) \end{bmatrix} \qquad \text{Eq. 12}$$

Another way to orthogonalized the matrix $\hat{T}$ is to apply the Singular Value Decomposition to $\hat{T}$. Omitting the S component will result in an orthogonal matrix $\tilde{T}$.

$$\hat{T} = USV^*$$

$$\tilde{T} = UV^* \qquad \text{Eq. 13}$$

Other statistical shape analysis procedures may be used, such as Procrustes analysis. For example, the Matlab® statistics toolbox function PROCRUSTES may be used to estimate $\hat{T}$. In accordance with this approach:

$$[dd, Z, tr] = \text{procrustes}(X, Y, \text{'Scaling'}, \text{false}, \text{'Reflection'}, \text{false}) \qquad \text{Eq. 14}$$

where X is the transpose of the matrix with columns that are the measured direction vectors in the antenna reference frame; and Y is the transpose of the matrix with columns that are the direction vectors in the PAMD reference frame. The best fit rotation matrix will be returned as 'tr.T'. Note that the Procrustes function determines the matrix that fits the form:

$$\bar{D}''^T = \bar{D}'^T \hat{T}^T \qquad \text{Eq. 15}$$

In one embodiment in which Procrustes or other statistical shape analysis methods are used, the roll, pitch and yaw offsets may be computed directly from the orthogonal matrix as well. The elements of T may be used to derive the roll, pitch and yaw offsets of the antenna positioner relative to the PAMD 114.

$$T(R_0, P_0, Y_0) = \begin{bmatrix} r_{11} & r_{12} & r_{13} \\ r_{21} & r_{22} & r_{32} \\ r_{31} & r_{32} & r_{33} \end{bmatrix} = \begin{bmatrix} \cos(P_0)*\cos(Y_0) & \cos(P_0)*\sin(Y_0) & -\sin(P_0) \\ \sin(R_0)*\sin(P_0)*\cos(Y_0) - \cos(R_0)*\sin(Y_0) & \sin(R_0)*\sin(P_0)*\sin(Y_0) + \cos(R_0)*\cos(Y_0) & \sin(R_0)*\cos(P_0) \\ \cos(R_0)*\sin(P_0)*\cos(Y_0) + \sin(R_0)*\sin(Y_0) & \cos(R_0)*\sin(P_0)*\sin(Y_0) - \sin(R_0)*\cos(Y_0) & \cos(R_0)*\cos(P_0) \end{bmatrix} \quad \text{Eq. 16}$$

The solutions are then $$Y_0 = \tan^{-1}(r_{12}/r_{11})$$

$$P_0 = \tan^{-1}(-r_{13}/\sqrt{r_{23}^2 + r_{33}^2})$$

$$R_0 = \tan^{-1}(r_{23}/r_{33}) \quad \text{Eq. 17}$$

Alternatively, since the vector $\vec{d}''_i$ has the elevation error, multiplying it as noted in Eq. 11 will result in a vector $\tilde{w}_i$. The z component of the vector $\tilde{w}_i$ can be used to calculate the elevation angle $\tilde{\varepsilon}_i$ for each measurement i as follows:

$$\tilde{\varepsilon}_i = \sin^{-1}(w_{iz}) \quad \text{Eq. 18}$$

The elevation offset can be determined by taking the average of the difference between the elevations $\tilde{\varepsilon}_i$ for each measurement i and the ideal topocentric elevation angle $\tilde{\varepsilon}_o$ (i.e., the elevation from the PAMD 114 to the satellite absent any offset or constant elevation error).

$$\Delta\varepsilon = \frac{1}{N}\sum_{i=1}^{N} \tilde{\varepsilon}_i - \varepsilon_0 \quad \text{Eq. 19}$$

Once the constant elevation error Δε is determined, the roll, pitch and yaw offsets can be recalculated using elevation angles that have been corrected for the constant elevation error Δε.

Although the disclosed method and apparatus is described above in terms of various examples of embodiments and implementations, it should be understood that the particular features, aspects and functionality described in one or more of the individual embodiments are not limited in their applicability to the particular embodiment with which they are described. For example, it is possible to use quaternions to express the relationships of the different reference frames to one another and thus determine the offset between the antenna reference frame and the PAMD reference frame by taking measurements at various orientations as described above. Furthermore, some or all aspects of the disclosed method and apparatus may be implemented in hardware or software, or a combination of both (e.g., programmable logic arrays). Various general purpose computing machines may be used with programs written in accordance with the teachings herein. Alternatively, a special purpose computer or special-purpose hardware (such as integrated circuits) may be used to perform particular functions. Thus, the disclosed method and apparatus may be implemented in one or more computer programs executing on one or more programmed or programmable computer systems.

Each such computer program may be stored on or downloaded to (for example, by being encoded in a propagated signal and delivered over a communication medium such as a network) a tangible, non-transitory storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein. Thus, the breadth and scope of the claimed invention should not be limited by any of the examples provided in describing the above disclosed embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide examples of instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosed method and apparatus may be described or claimed in the singular, the plural is contemplated to be within the scope thereof unless limitation to the singular is explicitly stated.

Additionally, the various embodiments set forth herein are described with the aid of block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration. Further, some of the steps described above may be order independent, and thus can be performed in an order different from that described. Various activities described with respect to the embodiments identified above can be executed in repetitive, serial, or parallel fashion.

What is claimed is:

1. An antenna alignment module (AAM) comprising:

a. a first output port through which the AAM provides control signals to control a position of a satellite antenna mounted on a platform, the platform comprising a position and attitude measurement device (PAMD);

b. at least one processor configured to:

i. take a plurality of attitude measurements indexed according to an index i, each of the plurality of attitude measurements taken at an i-th orientation of a plurality of orientations and including:

1. determining a first vector $\vec{d}_i$ from the satellite antenna to a satellite based on a location of the platform in the i-th orientation and a location of the satellite, the first vector $\vec{d}_i$ being represented by coordinates defined with respect to a fixed reference frame;

2. determining a second vector $\vec{d}'_i$ by performing an alias transformation on the first vector $\vec{d}_i$, the alias transformation transforming the coordinates of the first vector $\vec{d}_i$ from the fixed reference frame to a reference frame of the PAMD based on an attitude of the PAMD when in the i-th orientation; and 3. determining a third vector $\vec{d}''_i$ from the satellite antenna to the satellite based on an attitude of the satellite antenna when peaked to the satellite with the platform in the i-th orientation, the third vector $\vec{d}''_i$ being represented in coordinates defined with respect to a reference frame of the satellite antenna;

ii. accumulate a collection of the second vectors $\vec{d}'_i$ and accumulate a collection of the third vectors $\vec{d}''_i$ based on the plurality of attitude measurements;

iii. estimate a first rotation matrix $\hat{T}$ based on the accumulated collection of second vectors $\vec{d}'_i$ and the accumulated collection of third vectors $\vec{d}''_i$;

iv. determine a roll offset, a pitch offset and a yaw offset between the reference frame of the PAMD and the reference frame of the satellite antenna based on the first rotation matrix $\hat{T}$; and v. output, upon receiving information indicating a second location of the platform, control signals for pointing the satellite antenna at the satellite based on the information and the determined roll, pitch and yaw offsets.

2. The AAM of claim 1, wherein the control signals output for pointing the satellite antenna include information that can be used to determine an azimuth angle and an elevation angle to be applied to the satellite antenna to point the satellite antenna at the satellite.

3. The AAM of claim 1, wherein the control signals output for pointing the satellite antenna include the roll, pitch and yaw offsets.

4. The AAM of claim 1, further including at least one input port through which the AAM receives information regarding at least one of the following:

a. the attitude of a PAMD mounted on the platform on which the satellite antenna is mounted;

b. the location of the platform;

c. the location of the satellite; and d. the attitude of the satellite antenna.

5. The AAM of claim 1, wherein the AAM comprises the PAMD.

6. The AAM of claim 1, wherein the location of the satellite and the location of the platform are each represented by coordinates defined with respect to the fixed reference frame.

7. The AAM of claim 1, further comprising determining the attitude of the PAMD when in the i-th orientation, wherein the determining includes:

a. determining the attitude of the PAMD at a first time prior to the platform being in the i-th orientation;

b. determining a rate of change in the attitude of the PAMD at the first time; and c. determining the attitude of the PAMD at a second time when the platform is in the i-th orientation from the attitude and rate of change in the PAMD determined at the first time.

8. The AAM of claim 1, further comprising determining an attitude of the platform when the platform is in the i-th orientation, wherein the determining includes:

a. determining the attitude of the PAMD at a first time, the first time occurring after the platform was in the i-th orientation;

b. determining a rate of change of the attitude of the PAMD at the first time; and c. determining the attitude of the PAMD when the platform was in the i-th orientation from the attitude and the rate of change determined at the first time.

9. The AAM of claim 1, wherein the platform is an aircraft.

10. The AAM of claim 9, wherein the aircraft is on a ground surface in the i-th orientation.

11. The AAM of claim 10, wherein the aircraft is rotated on the ground surface to the plurality of orientations.

12. The AAM of claim 9, wherein at least some of the attitude measurements are taken in flight.

13. The AAM of claim 9, wherein at least some of the attitude measurements are taken during ground movement of the aircraft.

14. The AAM of claim 1, wherein a measurement of the plurality of attitude measurements indicating the attitude of the satellite antenna is taken via an antenna positioning motor.

15. The AAM of claim 1, wherein a measurement of the plurality of attitude measurements indicating the attitude of the satellite antenna is taken via position determining sensors coupled to the satellite antenna.

16. The AAM of claim 4, wherein a measurement regarding an attitude of the platform is received from the PAMD.

17. The AAM of claim 16, wherein the PAMD includes at least an Inertial Reference Unit (IRU).

18. The AAM of claim 17, the PAMD further including a global positioning system (GPS), the GPS providing the location of the platform to the AAM.

19. The AAM of claim 1, wherein pointing the satellite antenna at the satellite includes:

a. receiving an attitude of the platform;

b. determining a fourth vector from the platform to the satellite based on the location of the satellite and the second location of the platform;

c. performing an alias transformation on the fourth vector based on an attitude of the platform to determine a fifth vector;

d. performing a second alias transformation on the fifth vector based on the roll, pitch, and yaw offsets to determine a sixth vector; and e. pointing the satellite antenna at the satellite based on the sixth vector.

20. The AAM of claim 19, wherein pointing the satellite antenna at the satellite includes determining an azimuth angle and an elevation angle to be provided to an antenna positioning motor from the sixth vector.

21. The AAM of claim 1, the at least one processor further configured to account for an error in a measurement of the attitude of the satellite antenna when peaked to the satellite.

22. The AAM of claim 21, the error in the measurement indicating the attitude of the satellite antenna includes an error in an elevation angle of the satellite antenna when peaked to the satellite.

23. The AAM of claim 21, the at least one processor further configured to perform the alias transformation on the first vector by multiplying the first vector by a second rotation matrix $M_i$ and the processor further configured to account for the error in the measurement indicating the attitude of the satellite antenna when peaked to the satellite by multiplying the third vector by the transpose of an orthogonalized version of the first rotation matrix $\hat{T}$ and by the transpose of the second rotation matrix $M_i$.

24. A method for aligning an antenna to an attitude determining device, the antenna and the attitude determining device mounted on a platform, the antenna having an antenna reference frame and the attitude determining device having an attitude determining device reference frame, the method comprising:

a. taking a plurality of attitude measurements indexed according to an index i, each of the plurality of attitude measurements taken at an i-th orientation of a plurality of orientations, to determine:

i. a first vector $\vec{d}_i$ from the antenna to a satellite, the first vector being determined based on a location of the platform in the i-th orientation as determined by a position measuring device and a location of the satellite; and ii. a second vector $\vec{d}'_i$ by performing an alias transformation on the first vector $\vec{d}_i$ from a fixed reference frame to the attitude determining device reference frame based on an attitude of the platform;

iii. a third vector $\vec{d}''_i$ from the antenna to the satellite when the antenna is peaked to the satellite with the platform in the i-th orientation, the third vector being represented by coordinates defined with respect to the antenna reference frame, the third vector $\vec{d}''_i$ being determined based on information indicating an attitude of the antenna;

b. accumulating a collection of the second vectors $\vec{d}'_i$ and a collection of the third vectors $\vec{d}''_i$ based on the plurality of attitude measurements;

c. estimating a first rotation matrix $\hat{T}$ based on the accumulated collection of second vectors $\vec{d}'_i$ and the accumulated collection of third vectors $\vec{d}''_i$;

d. determining a rotational offset between the antenna reference frame and the attitude determining device reference frame based on the first rotation matrix $\hat{T}$; and e. pointing, upon receiving information indicating a second location of the platform, the antenna at the satellite based on the information indicating the second location and the rotational offset.

25. The method of claim 24, wherein the rotational offset is an offset in roll, pitch and yaw with respect to the attitude determining device reference frame.

26. The method of claim 24, further including:

a. using the roll, pitch and yaw offset to determine a second rotation matrix;

b. receiving information indicating the location of the satellite;

c. receiving the information indicating the second location of the platform;

d. determining a fourth vector based on the location of the satellite and the second location of the platform;

e. taking an attitude measurement indicating the attitude of the platform;

f. determining a fifth vector by performing an alias transformation on the fourth vector from the fixed reference frame to the attitude determining device reference frame based on the attitude of the platform; and g. determining a sixth vector by performing an alias transformation on the fifth vector using the second rotation matrix; and h. pointing the antenna to the satellite based on the sixth vector.

27. The method of claim 24, wherein the platform is an aircraft.

28. The method of claim 24, wherein taking an attitude measurement of the platform is based on an output from a position and attitude determining device (PAMD).

29. The method of claim 28, wherein the PAMD is an inertial reference unit (IRU).

30. The method of claim 29, wherein the PAMD includes a global positioning system to determine the location of the platform.

31. The method of claim 24, wherein the information indicating the attitude of the antenna is provided by an antenna positioning motor.

32. The method of claim 24, wherein the information indicating the attitude of the antenna is provided by at least one sensor for sensing a position of the antenna.

33. A non-transitory computer-readable medium encoding program instructions operable to cause one or more machines to perform operations comprising:

a. taking a plurality of attitude measurements indexed according to an index i, each of the plurality of attitude measurements taken at an i-th orientation of a plurality of orientations, to determine:

i. a first vector $\vec{d}_i$ from an antenna to a satellite, the first vector being determined based on a location of a platform in the i-th orientation as determined by a position measuring device and a location of the satellite; and ii. a second vector $\vec{d}'_i$ by performing an alias transformation on the first vector $\vec{d}_i$ from a fixed reference frame to a reference frame of the position measuring device based on an attitude of the platform;

iii. a third vector $\vec{d}''_i$ from the antenna to the satellite when the antenna is peaked to the satellite with the platform in the i-th orientation, the third vector being represented by coordinates defined with respect to reference frame of the antenna, the third vector $\vec{d}''_i$ being determined based on information indicating an attitude of the antenna;

b. accumulating a collection of the second vectors $\vec{d}'_i$ and a collection of the third vectors $\vec{d}''_i$ based on the plurality of attitude measurements;

c. estimating a first rotation matrix $\hat{T}$ based on the accumulated collection of second vectors $\vec{d}'_i$ and the accumulated collection of third vectors $\vec{d}''_i$;

d. determining a rotational offset between the reference frame of the antenna and the reference frame of the position measuring device based on the first rotation matrix $\hat{T}$; and e. pointing, upon receiving information indicating a second location of the platform, the antenna at the satellite based on the determined rotational offset and the information indicating the second location.

34. The non-transitory computer-readable medium of claim 33, wherein the rotational offset is an offset in roll, pitch and yaw with respect to the reference frame of the position measuring device.

35. The non-transitory computer-readable medium of claim 34, wherein the program instructions are operable to cause the one or more machines to perform operations comprising:

a. using the roll, pitch and yaw offset to determine a second rotation matrix;

b. receiving information indicating the location of the satellite;

c. receiving the information indicating the second location of the platform;

d. determining a fourth vector based on the location of the satellite and the second location of the platform;

e. taking an attitude measurement indicating the attitude of the platform;

f. determining a fifth vector by performing an alias transformation on the fourth vector from the fixed reference frame to the reference frame of the position measuring device based on the attitude of the platform; and g. determining a sixth vector by performing an alias transformation on the fifth vector using the second rotation matrix; and h. pointing the antenna to the satellite based on the sixth vector.

36. An antenna control unit (ACU) for generating and providing control signals to control a position of a satellite antenna mounted on a mobile platform, the mobile platform comprising a position and attitude measuring device (PAMD) and at least one processor configured to:

a. take a plurality of attitude measurements indexed according to an index i, each of the plurality of attitude measurements taken at an i-th orientation of a plurality of orientations and being determined by:

i. determining a first vector $\vec{d}'_i$ from the satellite antenna to a satellite based on a location of the mobile platform in the i-th orientation and a location of the satellite, the first vector $\vec{d}_i$ being represented by coordinates defined with respect to a fixed reference frame;

ii. determining a second vector $\vec{d}'_i$ by performing an alias transformation on the first vector $\vec{d}_i$, the alias transformation transforming the coordinates of the first vector $\vec{d}$ from the fixed reference frame to a reference frame of the PAMD based on an attitude of the mobile platform when in the i-th orientation; and iii. determining a third vector $\vec{d}''_i$ from the antenna to the satellite based on an attitude of the satellite antenna when peaked to the satellite with the mobile platform in the i-th orientation, the third vector $\vec{d}''_i$ being represented in coordinates defined with respect to a reference frame of the satellite antenna;

b. accumulate a collection of the second vectors $\vec{d}'_i$ and accumulate a collection of the third vectors $\vec{d}''_i$ based on the plurality of attitude measurements;

c. estimate a rotation matrix $\hat{T}$ based on the accumulated collection of second vectors $\vec{d}'_i$ and the accumulated collection of third vectors $\vec{d}''_i$;

d. determine a roll, pitch, and yaw offset between the reference frame of the PAMD and the reference frame of the satellite antenna based on the rotation matrix $\hat{T}$; and e. point, upon receiving information indicating a second location of the mobile platform, the satellite antenna at the satellite based on the information indicating the second location and the roll, pitch and yaw offsets.

* * * * *